United States Patent [19]

Woods et al.

[11] Patent Number: 4,959,637

[45] Date of Patent: Sep. 25, 1990

[54] EMERGENCY SIGNALING DEVICE

[75] Inventors: Richard E. Woods, Markle; Guy Bonner, Jr.; Jerry S. Smyth, both of Huntington; Roger D. Felton, Fort Wayne, all of Ind.

[73] Assignee: National Safety Devices, Inc., Fort Wayne, Ind.

[21] Appl. No.: 390,088

[22] Filed: Aug. 7, 1989

[51] Int. Cl.[5] ..... G08B 23/00

[52] U.S. Cl. ..... 340/573; 340/539; 340/693; 340/321; 340/326

[58] Field of Search ..... 340/573, 693, 321, 326, 340/539

[56] References Cited

U.S. PATENT DOCUMENTS

| | | | |
|---|---|---|---|
| 3,248,723 | 4/1966 | Miethe | 340/573 |
| 4,418,337 | 11/1983 | Bader | 340/573 |
| 4,468,656 | 8/1984 | Clifford et al. | 340/573 |
| 4,665,385 | 4/1987 | Henderson | 340/573 |
| 4,716,402 | 12/1987 | Francis | 340/546 |
| 4,746,912 | 5/1988 | Clifford et al. | 340/573 |

*Primary Examiner*—Joseph A. Orsino
*Assistant Examiner*—Geoff Sutcliffe
*Attorney, Agent, or Firm*—Pearne, Gordon, McCoy & Granger

[57] ABSTRACT

An emergency signaling device adapted to attach to an existing flashlight is disclosed. The device provides audio, optical and radio frequency alarms when the device detects no movement for a period of time. The radio frequency alarm is coded so that a plurality of the devices may be used in conjunction with a receiver to form an emergency signaling system. The receiver decodes the signal and indicates which device has transmitted the alarm. The device uses the battery in the flashlight for power. A noxious gas detector may also be integrated into the device.

2 Claims, 5 Drawing Sheets

EMERGENCY SIGNALING DEVICE

BACKGROUND OF THE INVENTION

The invention relates to devices for assisting in the identification and location of persons in distress, particularly those in heavy fog or smoke.

Many firemen have lost their lives or been seriously injured because they became trapped, injured or disoriented in a burning structure and their comrades either did not know they were in distress or could not find them quickly.

Several devices have been developed to aid in this problem. Self-contained units that emit sound and/or light in an emergency have been employed. These include devices that emit a loud alarm when the device senses no movement for a period of time.

These devices have their own batteries and are meant to attach to the fireman's helmet, clothing or breathing apparatus.

None of these devices offer much help for the fireman who becomes incapacitated out of the hearing/visual range of these devices. By the time the firemen is missed, it may be too late.

SUMMARY OF THE INVENTION

An emergency signaling system is disclosed. The system comprises one or more emergency signaling devices. Each of these devices comprises a housing, a control means located within the housing, a motion detector located within the housing and operatively connected to the control means, and a coded radio frequency alarm transmitter located within the housing and operatively connected to the control means. A coded radio frequency alarm associated with a particular signaling device is produced if there is no movement of the particular device for a desired period of time. The alarm may of course be triggered manually as well.

The signaling system also comprises an emergency signal receiver having a coded radio frequency alarm receiver, an alarm decoder operatively connected to the receiver means, and an alarm indicator operatively connected to the decoder. The occurrence of the coded radio frequency alarm is detected and identified with the particular signaling device.

Unlike prior art devices, this allows the monitoring of personnel safety from a central control point. The occurrence of an emergency is promptly signaled and the identity of the person in trouble may be immediately determined from the previously assigned coded radio signal. Help may then be dispatched to the person's last known location. The radio alarm signal will typically have a much greater effective range than the prior art audio and visual alarms.

In the preferred embodiment, the emergency signaling device is adapted to attach to a flashlight. The housing screws onto the flashlight and uses the flashlight's batteries for power. This avoids the purchase and maintenance of separate batteries for the signaling device. In addition, as the signaling device becomes an integral part of the flashlight, one less piece of equipment need be kept track of, affixed to the user, and manipulated.

Various other alarm indicators may be advantageously provided: an audio alarm may be included within the housing and operatively connected to the control means; a means to flash the lamp of the flashlight as an alarm may be included; a strobe light alarm may be located within the housing and operatively connected to the control means.

The emergency signaling device may also be provided with a noxious gas detector, which can also trigger the various alarms upon detection of dangerous gases.

DETAILED DESCRIPTION OF THE PREFERRED EMBODIMENTS

Figure 1:
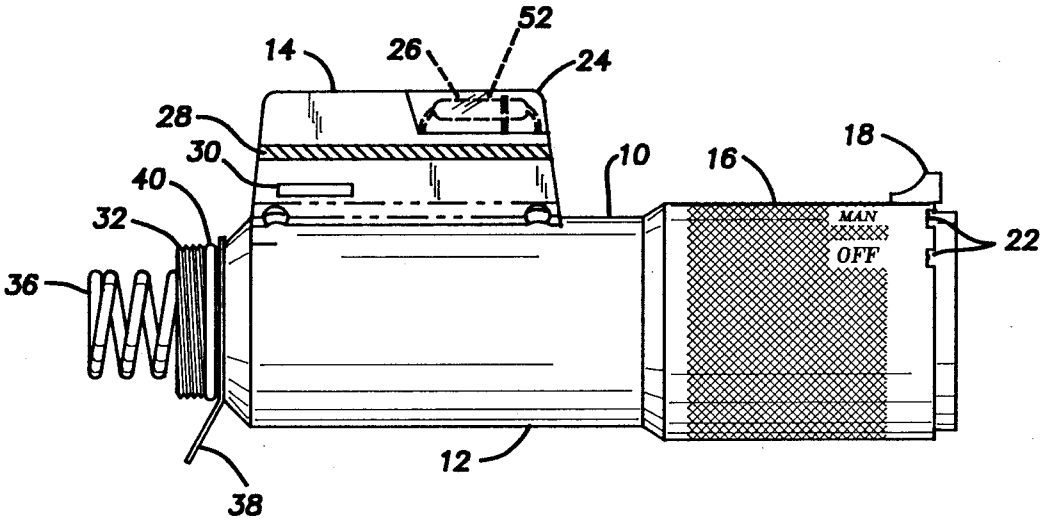
FIG. 1 is a side elevation view of the emergency signaling device of the invention.

An emergency signaling device 10 is shown in FIG. 1. A barrel 12 and a cover 14 provide a housing for electrical components more fully described below.

A rotating sleeve 16 received about the barrel 12 acts as a control knob for the device 10. A thumb knob 18 is provided to disengage a detent arm 20 (see FIG. 4) that normally engages one of the detents 22 in the sleeve 16. When the knob 18 is pushed axially away from the detents 22, the sleeve 16 may be axially rotated to switch to the various operating modes of the device 10. Except when the knob 18 is pressed, the device 10 is firmly locked in a particular operating mode.

Both the barrel 12 and the sleeve 16 may be advantageously formed of a light and strong metal, for example, aluminum.

The cover 14 is provided with a transparent lens 24 that allows for the ready transmission of light from a strobe light 26. A luminescent strip 28 is integrated into the cover 14 to store a portion of the light of each strobe and to reradiate the light between strobes. Also, a transparent window 30 is provided in the cover 14 to allow the inspection of the transmitter code described below. In addition, the cover 14 is formed of a high impact plastic that is transparent to radio frequency signals.

Figure 2:
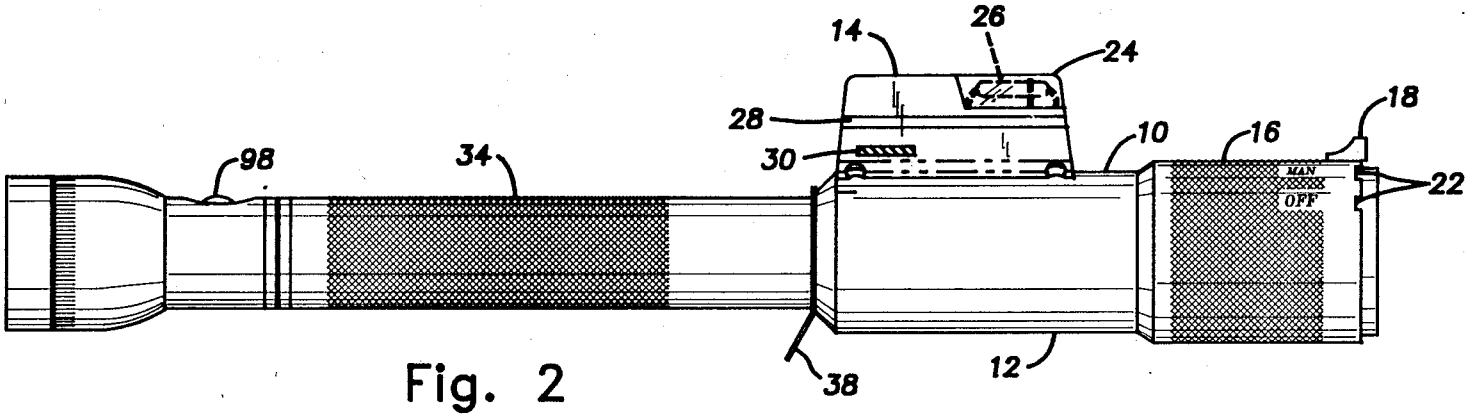
FIG. 2 is a side elevation view of the emergency signaling device of the invention shown attached to a flashlight.

In the preferred embodiment, the barrel 12 is provided with a threaded end 32 that is dimensioned to be threaded into the end of an already existing flashlight 34 as shown in FIG. 2. In addition, a contact spring 36 is coaxially mounted within the barrel 12. The spring 36 provides electrical contact with one pole of one or more batteries already present in the flashlight 34.

Spring 36, along with an unshown connection to the opposite polarity terminal of the batteries within the flashlight 34, allows operation of the device 10 using the batteries of the flashlight 34 for power as well as interruption of power to the flashlight's bulb when desired.

A lanyard securing ring 38 may be provided at the threaded end 32 to allow securing the flashlight 34 and device 10 combination to a rope or cord. Also, an O-ring 40 may be positioned at the threaded end 32 to provide a watertight seal between the flashlight 34 and the device 10.

It would be possible to use the device 10 without the flashlight 34 by providing batteries dedicated solely to the device 10. The barrel 12 or other shaped container need only be designed to accommodate the dedicated batteries. However, in many cases, the user has to carry a flashlight anyway, thus two completely separate pieces of equipment would have to be carried, including batteries for both.

Figure 3:
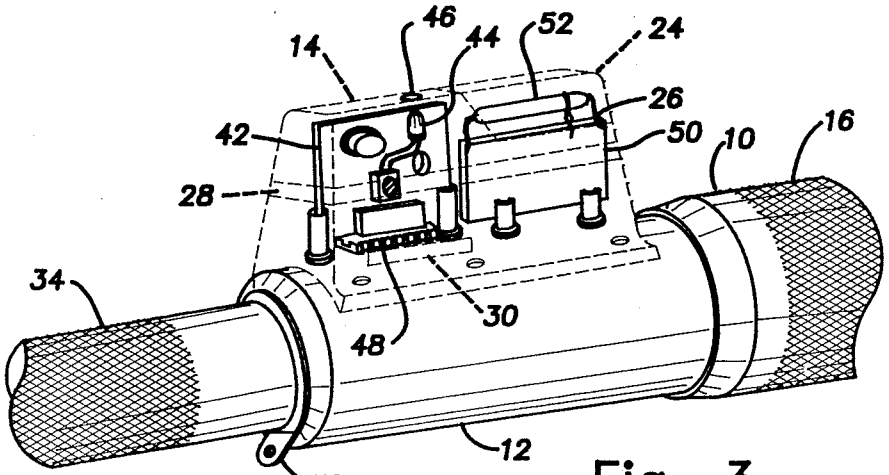
FIG. 3 is an exploded perspective view of the emergency signaling device of the invention.
Figure 4:
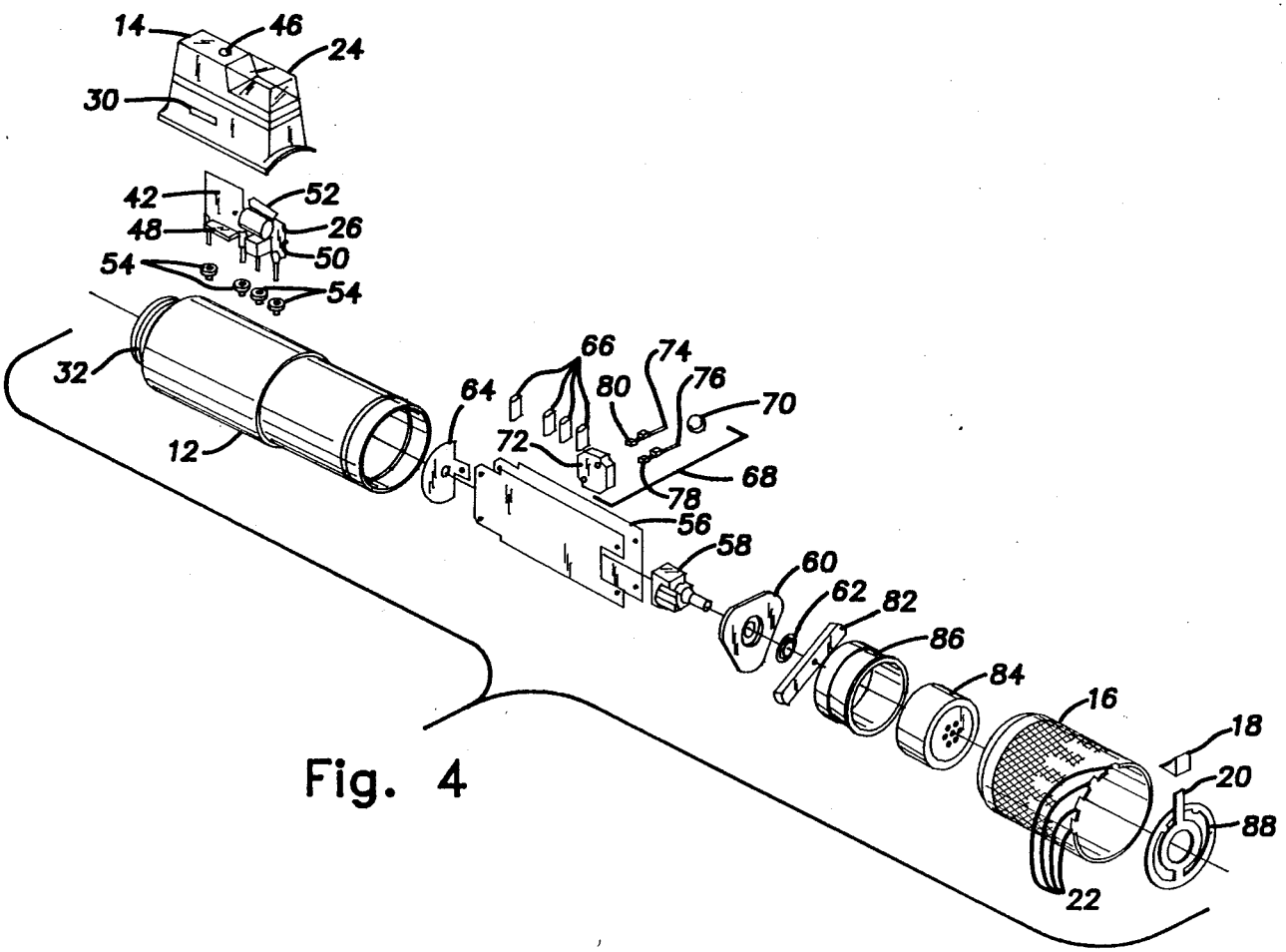
FIG. 4 is a partial perspective view of the emergency signaling device of the invention with the alarm cover shown in phantom lines.

FIGS. 3 and 4 show the electrical components within barrel 12 and cover 14.

A coded radio frequency transmitter 42 is mounted within the cover 14. An L.E.D. 44 on the transmitter 42 indicates when the transmitter 42 is transmitting. The L.E.D. may be viewed through a window 46 in the cover 14.

The coding of the transmitter 42 may be set by the positioning of the switches on a switch block 48. The transmitter may, for example, operate at about 310 MHz with the carrier pulse width modulated according to the binary code set on switch block 48. If switch block 48 has eight switches, 256 codes would be possible.

A high voltage supply 50 supports and powers a xenon flash tube 52 which together form the strobe light 26 mounted within the cover 14.

Insulating bushings 54 pass through the wall of the barrel 12 and provide a passage for the electrical leads of the transmitter 42 and the strobe light 26 to connect to an electronic control circuit 56 within the barrel 12.

A rotary function switch 58 is connected to the control circuit 56 at one end thereof. A bracket 60 is attached to the switch 58 by a nut 62.

The bracket 60 and a retainer 64 at the opposite end of the control circuit 56 serve to position the control circuit 56 within the barrel 12.

Sockets 66 are connected to the control circuit 56 and receive the electrical leads from the transmitter 42 and the strobe light 26.

A motion detector 68 is also connected to and mounted on the control circuit 56.

In the preferred embodiment, the motion detector 68 is made up of a ball 70, opaque cage 72, L.E.D.s 74 and 76, and phototransistors 78 and 80.

The ball 70 is retained in a circular chamber (not shown) in the cage 72, the control circuit 56 serving as one wall of the chamber when the cage 72 is attached to the same. The L.E.D. 74 is mounted diametrically opposite phototransistor 78 on the cage 78. Small holes in the cage 72 allow the L.E.D. 74 and the phototransistor 78 to optically communicate except when the ball 70 moves between the two.

The L.E.D. 76 and the transistor 80 are mounted similarly on the cage 72, except at 90 degrees to the first L.E.D./transistor pair.

The L.E.D.s 74, 76 and the phototransistors 78, 80 are connected to the control circuit 56.

Any motion of the device 10 causes the ball 70 to move about inside the cage 72 thereby intermittently preventing light from the diodes from reaching their respective phototransistors. This intermittent interruption indicates that movement of the device 10 is occurring.

It is of course possible to substitute other types of motion detectors, from simple mercury switches to sophisticated accelerometers.

A selector bar 82 is attached to the shaft of rotary function switch 58. The ends of the bar 82 engage the inside of the sleeve 16 when it is in position over the barrel 12. When the sleeve 16 is axially rotated, the switch 58 is moved to different function positions corresponding to the detents 22.

A sounder 84 is retained within a bushing 86. The bushing 86 is dimensioned to water-tightly hold the sounder 84 concentrically within the barrel 12. The terminals of sounder 84 are connected to the control circuit 56. The sounder 84 may, for example, be capable of producing an audible alarm of 105 db at one meter.

A retainer 88, which includes the detent arm 20, attaches to the end of the barrel 12 and serves to retain the control circuit 56 and the sounder 84 within the barrel 12 and the sleeve 16 on the barrel 12.

Figure 5:
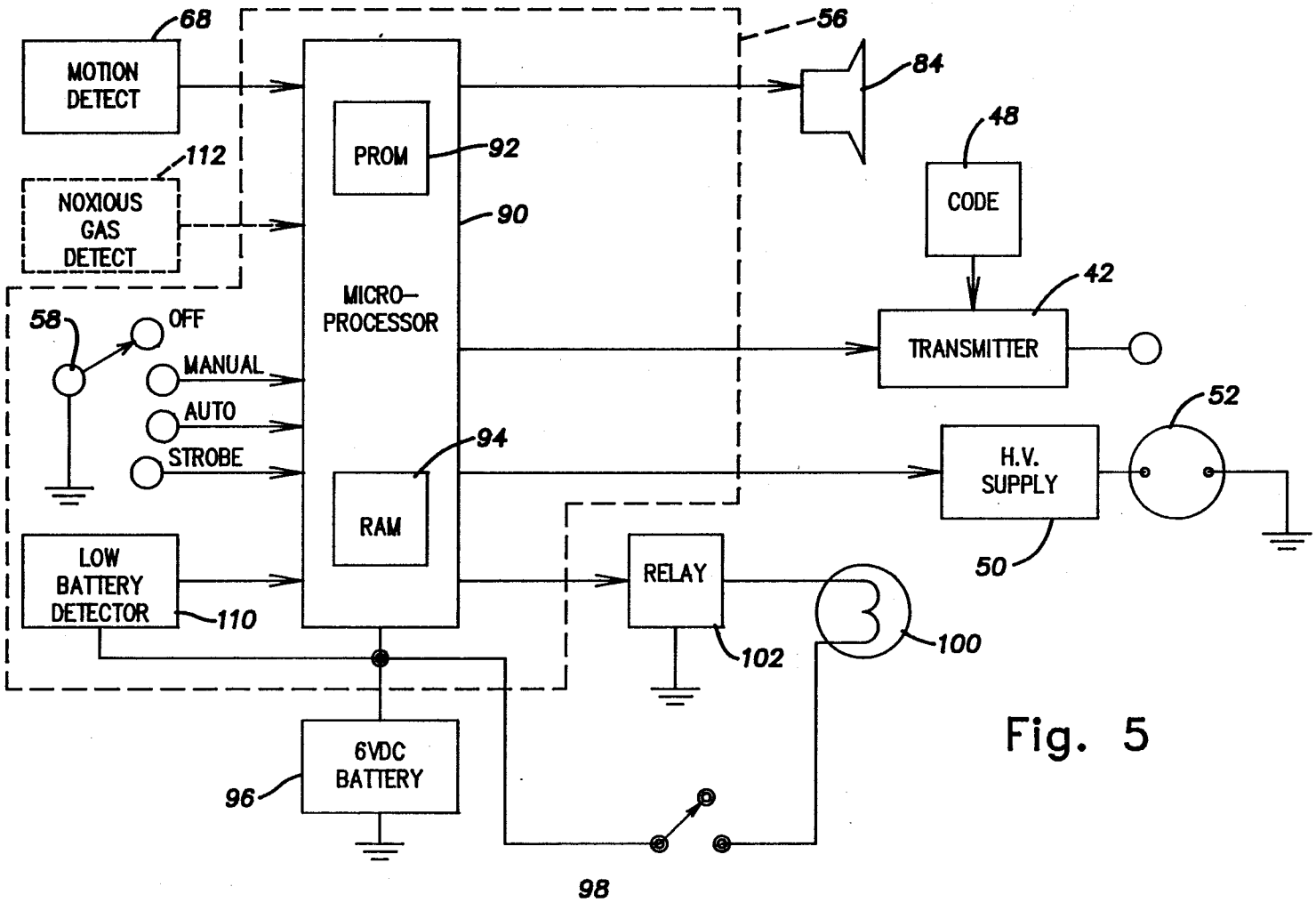
FIG. 5 is a block diagram of the emergency signaling device of the invention.

Referring to FIG. 5, the control circuit 56 in the preferred embodiment is shown.

The microprocessor 90 monitors all inputs and controls all outputs subject to instructions already contained in a read-only memory 92 and keeps any necessary intermediate values in a memory 94.

The read-only memory 92 and the memory 94 may be either on-board the microprocessor 90 as shown or be separate chips.

The rotary function switch 58 has four positions, indicated as "OFF", "MANUAL", "AUTO" and "STROBE". The input to the microprocessor 90 from each position of the switch 58 causes the microprocessor 90 to perform a different set of instructions stored in the read-only memory 92.

A battery 66 powers the circuits of the device 10. In the preferred embodiment, the battery 66 is the existing battery in the flashlight 34. Additionally, the switch 98 and the lamp 100 are also part of the flashlight 34.

When a relay 102 is switched to ground, the lamp 100, the switch 98 and the battery 96 work in the normal flashlight manner, the switch 98 controlling whether the lamp 100 is illuminated or not.

The control input of the relay 102 is provided from the microprocessor 90.

The microprocessor 102 also provides control inputs to the sounder 84, the radio frequency transmitter 42, and the high voltage supply 50.

As mentioned previously, the switch block 48 provides a distinguishing code to uniquely modulate the output of the transmitter 42.

When triggered, the supply 50 provides a pulse of high voltage (e.g. 10,000 volts) to the xenon flash tube 52. Once the gas in the tube 52 is ionized, energy at a lower high voltage (e.g. 100 volts) is dissipated in the tube 52, thereby producing the characteristic brilliant flashes of light.

The motion detector 68 provides an input to the microprocessor 90 indicative of motion of the device 10.

Additionally, a low battery detector circuit 110 may provide an input to the microprocessor 90 to permit the shedding of electrical loads as the battery 96 nears discharge.

When the function switch 58 is in the "OFF" position, the relay 102 connects the negative terminal of the lamp 100 to ground, thereby allowing the flashlight 34 to be used in strictly the normal manner. The sounder 84, the transmitter 42 and the strobe light 26 are all inactivated as well as all other circuitry of the device 10.

When the function switch 58 is in the "MANUAL" position, a full alarm mode is activated: the sounder 84 emits a full volume "warble" alarm, the transmitter 42 sends a coded radio frequency alarm, the strobe light 26 flashes, and if switch 98 is closed, the flashlight lamp 100 is turned on and off by the relay 102.

When the function switch 58 is in the "STROBE" position, only the strobe light 26 is activated. The flashlight 34 continues to operate in a conventional manner.

When the function switch 58 is in the "AUTO" position, the microprocessor 90 monitors the input from the motion detector 68. If no movement is indicated for a predetermined period of time (e.g. 27 seconds), the microprocessor 90 activates the sounder 84 in a reduced volume mode (e.g. an off/on beeping of reduced volume from the maximum).

If still no movement is indicated for an additional predetermined time (e.g. 7 seconds), the microprocessor 90 activates the full alarm mode: the sounder 84 emits a full volume "warble" alarm, the transmitter 42 sends a coded radio frequency alarm, the strobe light 26 flashes, and if switch 98 is closed, the flashlight lamp 100 is turned on and off by the relay 102.

If, instead, the device 10 is moved within the 7 seconds, the microprocessor 90 ceases the reduced volume operation of the sounder 84 and resumes waiting for a 27 second period of no movement.

If the device 10 is moved during the first occurrence of the full alarm mode, all alarms are deactivated and the microprocessor 90 resumes waiting for a 27 second period of no movement. However, if the full alarm mode is again activated, movement of the device 10 will have no further effect on the alarm mode. To deactivate the alarms during this second occurrence of the full alarm mode requires that the function switch 58 be moved to the "OFF" position, the microprocessor 90 thereby being reset to its original state.

This "latching" of the full alarm mode after the first occurrence of the full alarm mode is necessary because a semi-conscious person will often move in response to loud noises such as that produced by the sounder 84 at full volume.

To help conserve the battery 96 during alarm activation, initially, the lamp 100 (if the switch 98 is on) is cycled at a rate of about .5 seconds on and then 3 seconds off, the strobe light 26 flashes about once every 4 seconds and the transmitter 42 is cycled at a rate of about 1 second on and then 6 seconds off for 28 seconds followed by 14 seconds off before repeating.

If the low battery detector 110 indicates to the microprocessor 90 that the voltage of the battery 96 is such that only one hour of operation would remain if the full alarm mode was activated and no alarm mode is yet activated, the microprocessor 90 causes the sounder 84 to produce a rapid reduced volume beeping to warn the user of the battery condition.

During the full alarm mode, low battery detector 110 indicates to the microprocessor 90 the condition of the battery 96. When the voltage of the battery 96 drops to a specific value (e.g. 5.7 volts), the microprocessor 90 begins load shedding to conserve battery life. The lamp 100 is kept off by the relay 102 and the sounder 84 is turned off for about 12 seconds out of every 15 seconds.

If the battery voltage drops below another specific value (e.g. 3 volts), the strobe light 26 and the sounder 84 are both turned off.

The transmitter 42 continues to run through its cycle as long as sufficient energy remains in the battery 96.

It is of course possible to implement the device 10 without providing all of the alarm means describe above.

A further enhancement of the device 10 can be made by adding a noxious gas detector 112. The gas detector 112 provides a signal to the microprocessor 90 when a dangerous gas is present about the device 10. The microprocessor 90 reacts to this signal by energizing one or more of the alarms.

One or more of the emergency signaling devices 10 in combination with an emergency signal receiver 120 form an emergency signaling system.

Figure 6:
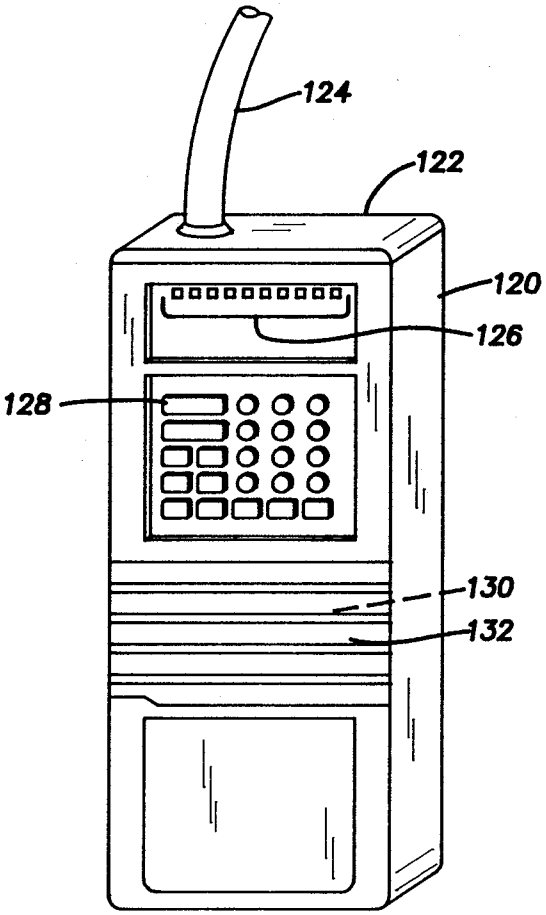
FIG. 6 is a perspective view of the emergency signal receiver of the invention.

Referring to FIG. 6, the receiver 120 comprises a housing 122 and an antenna 124 protruding therefrom. L.E.D.s 126 are mounted in the housing 122 to provide indicia of an emergency alarm. A keyboard 128 is mounted in the housing 122 to allow control of the receiver 120. A speaker 130 is mounted within the housing 122 and communicates with a grill 132 in the housing 122.

Figure 7:
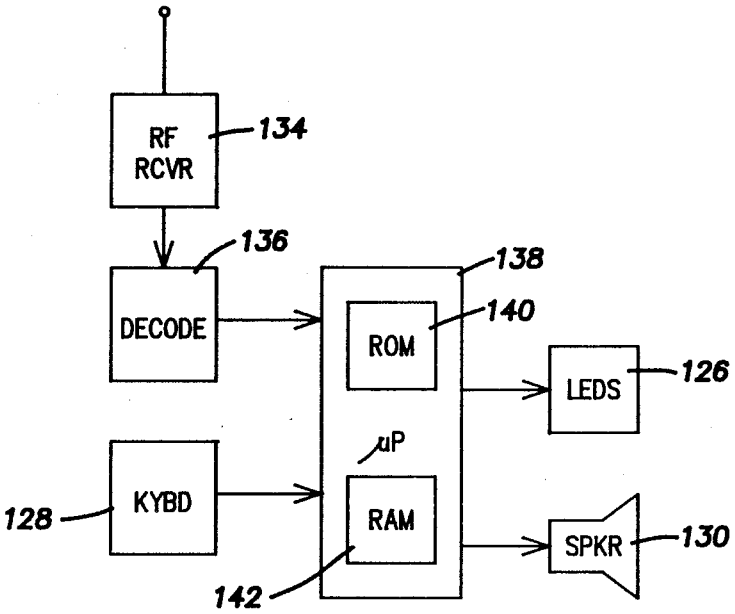
FIG. 7 is a block diagram of the emergency signal receiver of the invention.

FIG. 7 illustrates the electronics within the housing 122. The antenna 124 communicates with a radio frequency receiver 134. The radio frequency receiver output is connected to a decoder 136. The decoder 136 provide an input to a microprocessor 138.

The microprocessor 138 monitors all inputs and controls all outputs subject to instructions already contained in a read-only memory 140 and keeps any necessary intermediate values in a memory 142.

The read-only memory 140 and the memory 142 may be either on-board the microprocessor 138 as shown or be separate chips.

The keyboard 128 provides signals to the microprocessor 138.

The microprocessor 138 controls the L.E.D.s 126 and the speaker 130.

In operation, a coded radio frequency alarm signal (e.g. a 310 MHz coded r.f. signal) from the transmitter 42 in a device 10 is picked up by the antenna 124. The picked up signal is then detected by the receiver 134 which then supplies the detected signal to the decoder 136.

The decoder 136 identifies the code used in the transmission of the signal. As described above, the carrier frequency may be pulse width modulated according to the binary code set on switch block 48. The decoder 136 recovers the code used in the device 10 and supplies it to the microprocessor 138.

The keyboard 128 is used to input the code associated with each of the devices 10 in the system to the microprocessor 138. Each code input will correspond to one of the L.E.D.s 126. The code and the particular corresponding L.E.D.'s address is stored in the memory 142. This is done prior to putting the devices 10 into service.

Once the code information is stored in the memory 142, the microprocessor 138 can compare it to the code from decoder 136 and then light one of the L.E.D.s 126 to indicate which of the devices 10 has broadcast the alarm. The example shown could handle no more than ten devices 10, but it would be straightforward to alter the receiver 120 to accommodate a greater number.

Besides lighting one of the L.E.D.s 126 corresponding to a particular device 10, the microprocessor 138 may also sound an alarm through the speaker 130.

The lighting of one (or more) of the L.E.D.s 126 and the sounding of an alarm through the speaker 130 provide a rapid indication that a user of one of the devices 10 is in trouble. This indication is provided independently of smoke, fog or just plain obstructions to vision that prevent viewing of the lamp 100 or the strobe light 26. The indication is provided as well, even if the alarm from the sounder 84 is overpowered by other noise, or obstructions.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed:

1. An emergency signaling system comprising:

a plurality of emergency signaling devices, each said device having a housing, a control means located within said housing, a motion detection means located within said housing and operatively connected to said control means, an audio alarm means located within said housing and operatively connected to said control means, and a coded radio frequency alarm means located within said housing and operatively connected to said control means, whereby a first audio alarm is produced after a first period of no movement of a particular signalling device and a coded radio frequency alarm associated with the particular signaling device and a second audio alarm are produced if there is no movement of the particular device for a second period of time following the first period, said second audio alarm being louder than said first audio alarm; and an emergency signal receiver having coded radio frequency alarm receiver means, an alarm decoder operatively connected to said receiver means, and alarm indication means operatively connected to said decoder, whereby the occurrence of the coded radio frequency alarm may be detected and identified with the particular signaling device and wherein movement of the particular device during a first production of the coded radio frequency alarm cancels the same but has no effect on any subsequent production of the coded radio frequency alarm.

2. An emergency signaling device adapted to attach to a flashlight having a lamp and battery means, said device comprising:

a housing adapted to attach to the flashlight;

a control means located within said housing;

a motion detection means located within said housing and operatively connected to said control means;

an audio alarm means located within said housing and operatively connected to said control means;

a means to flash the lamp, said lamp flashing means located within the housing and operatively connected to said control means and said lamp;

a strobe light located within said and operatively connected to said control means; and a radio frequency alarm means located within said housing and operatively connected to said control means, said battery means providing electrical power for said control means, motion detection means, audio alarm means, lamp flashing means, strobe light and radio frequency alarm means, whereby a first audio alarm is produced after a first period of no movement of the device and a second audio alarm, a flashing lamp alarm, a strobe light alarm and a radio frequency alarm are produced if there is no movement of the device for a second period of time following the first period and wherein movement of the device during a first production of the second audio alarm, flashing lamp alarm, strobe light alarm and radio frequency alarm cancels same but has no effect on any subsequent production.

* * * * *